US006525250B2

(12) United States Patent
Goods

(10) Patent No.: US 6,525,250 B2
(45) Date of Patent: Feb. 25, 2003

(54) DIFFERENTIAL SUPPORTING OF DRUM HEADS

(75) Inventor: John J. Goods, Thousand Oaks, CA (US)

(73) Assignee: Drum Workshop, Inc., Oxnard, CA (US)

( * ) Notice: Subject to any disclaimer, the term of this patent is extended or adjusted under 35 U.S.C. 154(b) by 0 days.

(21) Appl. No.: 09/866,202

(22) Filed: May 29, 2001

(65) Prior Publication Data

US 2002/0178894 A1 Dec. 5, 2002

(51) Int. Cl.[7] ..... G10D 13/02
(52) U.S. Cl. ..... 84/411 R; 84/413; 84/411 A
(58) Field of Search ..... 84/411 R, 415, 84/411 A, 413

(56) References Cited

U.S. PATENT DOCUMENTS 4,448,105 A * 5/1984 Cordes ..... 84/415
5,404,785 A * 4/1995 Belli ..... 84/411 R
6,166,311 A 12/2000 Barrickman

* cited by examiner

*Primary Examiner*—Shih-Yung Hsieh
(74) *Attorney, Agent, or Firm*—William W. Haefliger

(57) ABSTRACT

In a drum assembly, the combination comprising a drum shell having opposite ends, drumheads at the opposite ends of the shell, and annular drumhead supports carried by the shell, the supports having head supporting annular rim zones with different angular configurations comprising a drum shell having opposite ends, drumheads at the opposite ends of the shell, and annular drumhead supports carried by the shell, the supports having head supporting annular rim zones with different angular configurations.

4 Claims, 3 Drawing Sheets

DIFFERENTIAL SUPPORTING OF DRUM HEADS

BACKGROUND OF THE INVENTION

This invention relates generally to drum structure, and more particularly to differential supporting of drum heads, as at two different diameters, at opposite ends of a drum.

In the past, drumheads at opposite ends of a drum were supported in like manner, as at equal diameters. It has now been found that the resonating effect of a drum when struck at a drumhead can be desirably enhanced if the two drumheads are differentially supported, at rims.

SUMMARY OF THE INVENTION

It is a major object of the invention to provide an improved drum assembly that comprises, in combination:

a) a drum shell having opposite ends, b) drumheads at said opposite ends of the shell, c) and annular drumhead supports carried by the shell, d) said supports having head supporting annular rim zones with differing angular configurations.

It is another object of the invention to provide such rim zones having or defining different bevels, and which are typically characterized by different angularities.

An additional object is provision of such rim zones characterized by different diameters, whereby the diameters and therefore the resonating areas of the two drumheads are different.

Yet another object is the provision of different diameter drumheads where two diameters differ by between 1 and 10%.

These and other objects and advantages of the invention, as well as the details of an illustrative embodiment, will be more fully understood from the following specification and drawings, in which:

DRAWING DESCRIPTION

DETAILED DESCRIPTION

Figure 1:
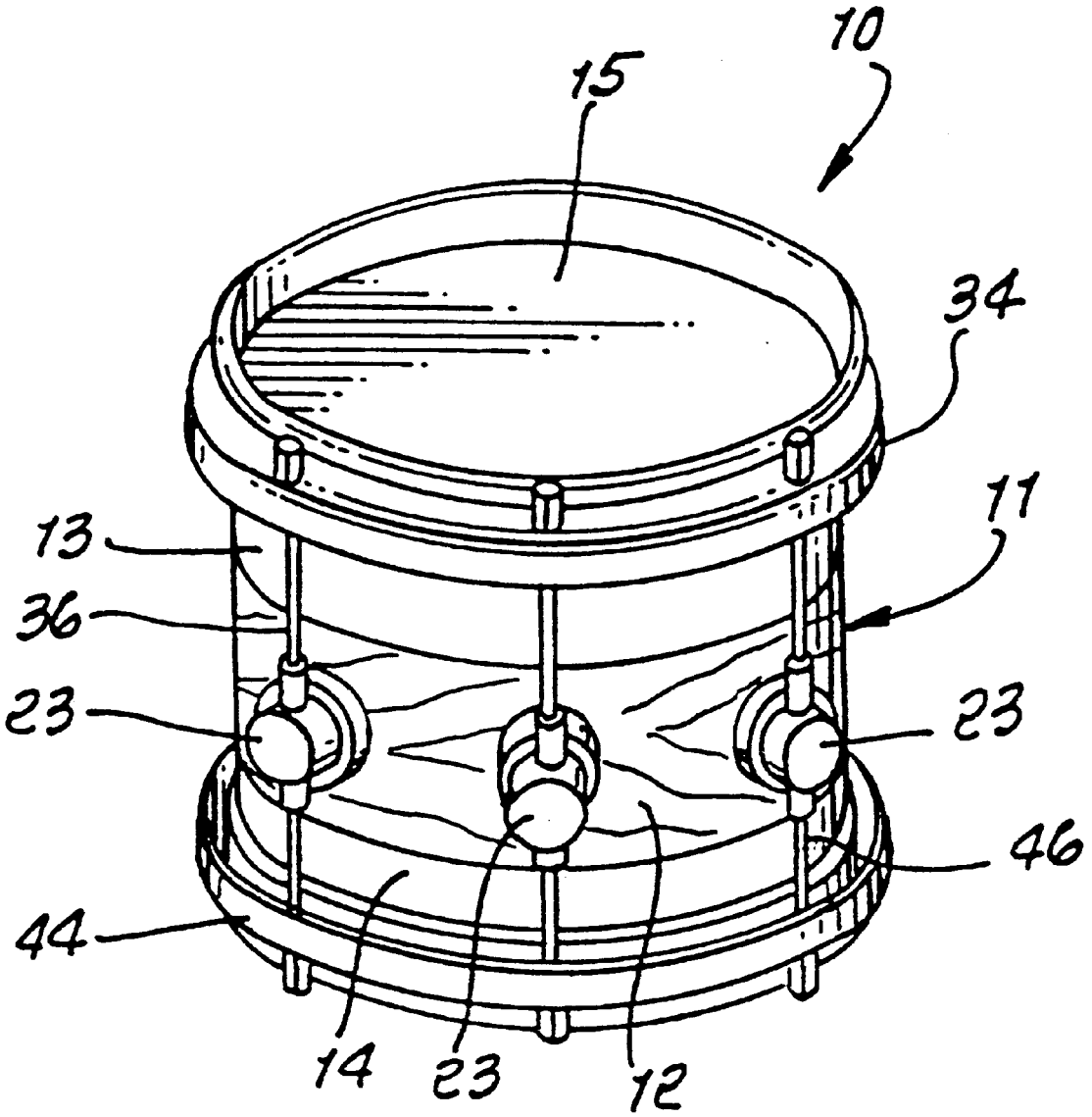
FIG. 1. PRIOR ART
FIG. 1 is a perspective view of a prior art drum.
Figure 2:
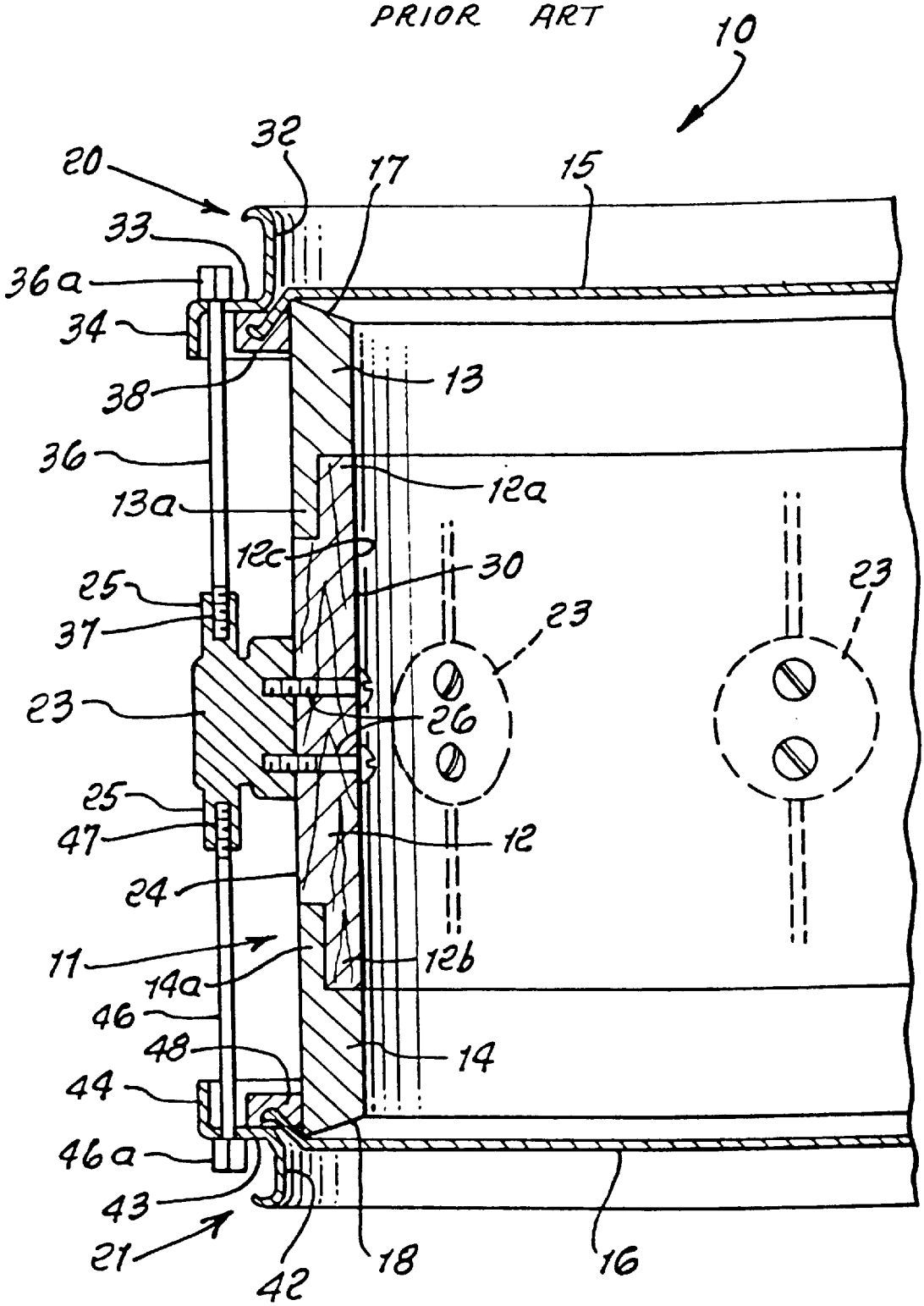
FIG. 2. PRIOR ART
FIG. 2 is a vertical section taken through one side of the FIG. 1 prior art drum.

In FIGS. 1 and 2, a prior art (see U.S. Pat. No. 5,377,576) drum 10 has a shell with cylindrical sections located in axially end-to-end position, at least a first section consisting of wood and at least second and third sections consisting of metal. In the example, the shell 11 has a first wall section 12 consisting of wood, a second wall section 13 consisting of metal, and a third wall section 14 consisting of metal. The section 12 is preferably located between sections 13 and 14, so that drumheads 15 and 16 may stretch over annular beveled metallic edges 17*a* and 18 that do not "weather" or otherwise change with atmospheric or other conditions. Sections 12 and 13 may have telescopic interfit with section 11, as for example at radially overlapping portions 12*a* and 13*a*, and radially overlapping portions 12*b* and 14*a*. Such connections are also referred to as "pin and box" connections, providing high radial and axial stability. Sections 13 and 14 consist of brass, and section 12 of maple, and their interfits may be tight. A wall consisting of one material may be employed.

Means is also provided for retaining the drumheads on the drum, including flanges at axial ends of the drum, retainers on one of the sections, and adjustable tensioning means interconnecting the flange means and retainer means. In the example, flange structure 20 is provided in association with metal section 13 of the shell, and flange structure 21 in association with metal section 14 of the shell. Retainer elements 23 are spaced about and adjacent the outer surface 24 of wooden section 12, mid-way between metal sections 13 and 14, and the elements 23 may have circular cross sections as shown and consist of brass. The elements 23 carry tubular holders 25 projecting vertically and parallel to the drum axis, but in axially opposite directions. Tightening adjustment fasteners 26 project radially through the shell section 12 to affix the elements 23 to the outer surface of the section 12.

The upper flange structure 20 has an upwardly extending annular rim portion 32 extending above the level of drumhead 15, a medial annular flange portion 33 extending radially outwardly below the level of 32, for transmitting head tightening loading, and a lower annular portion 34 extending downwardly from the outer extent of 33. A tightening adjustment fastener or tensioner rod 36 extends downwardly through 33, and its lower end has external threads 37 that interfit rotatably internal threads in upper holder 25. Note fastener head 36*a* bearing on the upper surface of 33. The lower surface of 33 exerts downward loading onto a retention ring 38 to which drumhead 15 is suitably attached, for tightening (or loosening) same, by drawing the head over 17.

Likewise, lower flange structure 21 has a downwardly extending annular rim or flange portion 43 extending below the level of drumhead 16, a medial annular portion 44 extending radially outwardly above the level of 42 for transmitting head tightening loading, and an upper annular portion 44 extending upwardly from outer extent of 43. A tightening adjusting fastener or tensioner rod 46 extends upwardly through 42, and has external threads 47 that interfit rotatably the internal threads in lower holder 25. Note fastener head 46*a* bearing on the lower surface of 42. The upper surface of 43 exerts upward loading onto lower retention ring 48 to which drumhead 16 is suitably attached, for tightening (or loosening) same, i.e. over bevel 18. Accordingly, the drumheads are individually adjustable; however, it is found that the tensioner rods 36 and 46 can loosen as by rotation in untightening direction, during or as a result of drumming.

Figure 3:
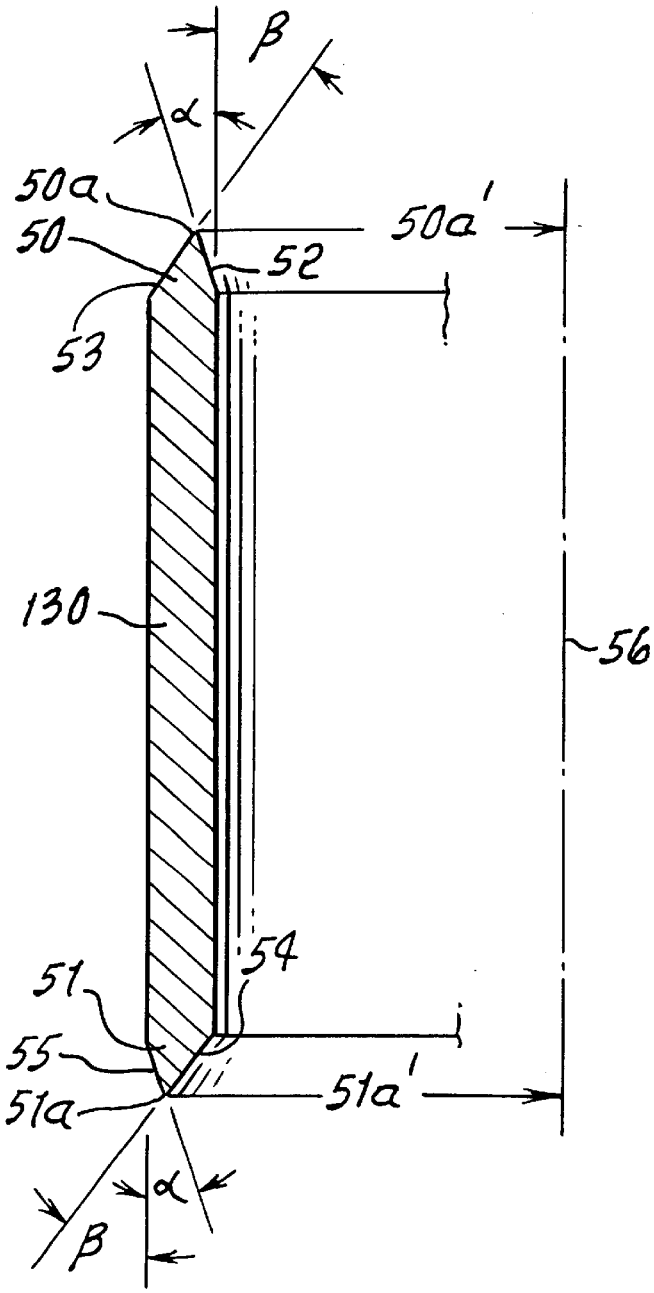
FIG. 3 is a section showing different bevels at the head supporting rim zones of a drum.

Referring now to FIG. 3, rim zones at opposite ends of a drum shell 130 are indicated at 50 and 51. Those zones taper toward apices 50*a* and 51*a*, at zone edges, which may be sharp or slightly convex. Opposite tapering and generally flat sides or flanks of the rim zones appear at 52 and 53, and 54 and 55. The acute angularities of beveled sides 52 and 53 are indicated at $\alpha$ and $\beta$, respectively. Sides 52 and 54 face inwardly toward the drum axis 56. It will be noted that angle $\beta$ exceeds angle $\alpha$, and that annular apex 50*a* is therefore closer to axis 55 in a radial direction than annular apex 51*a*. Note that radial dimension 51*a*' exceeds radial dimension 50*a*', and the differential is between 0.5 and 10%. Note also that flanks 54 and 55 also extend at different angles relative to axis 65.

Figure 4:
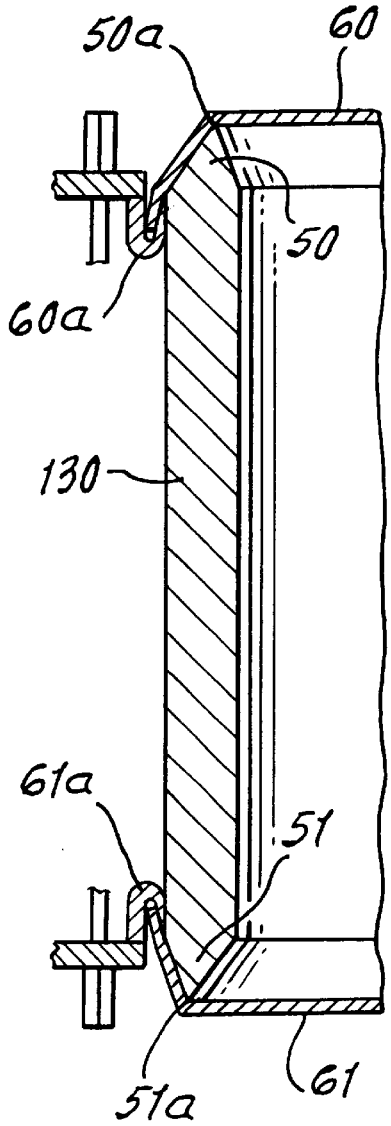
FIG. 4 is a view like FIG. 3, showing drumheads stretched over the differential diameter rim zones.

FIG. 4 is like FIG. 3, but shows drum heads 60 and 61 stretched over the annular apices 50*a* and 51*a*, and retained at 60*a* and 61*a*. When either drumhead is struck by a beater shaft, the audible resonation of the drum exceeds resonation that occurs when both heads are of the same supported diameter as for example the diameter of head 60.

I claim:

1. In a drum assembly, and for use with a beater, the combination comprising:

a) a drum shell having opposite ends, b) drum heads at said opposite ends of the shell, c) and annular drumhead supports carried by the shell, d) said supports having head supporting annular rim zones with different annular configurations, around major extent of the drum, e) said head supporting rim zones defining bevels, f) said rim zones defining annular apices toward which said bevels extend, said apices located at different radial distances from an axis defined by the shell, g) each of said rim zones having opposite flanks that taper toward an annular apex, the flanks furthest from said axis extending at different angles relative to said axis, h) whereby when either of said drum heads is struck by a beater, the audible resonation of the drum exceeds resonation that occurs when both heads are of the same supported diameter.

2. The combination of claim 1 wherein said heads are stretched over said bevels at said rim zones.

3. The combination of claim 1 wherein said angularities are acute, one acute angularity being substantially greater than the other acute angularity.

4. In a drum assembly, for use with a beater, the combination comprising a) a drum shell having opposite ends, b) drumheads at said opposite ends of the shell, c) and annular drumhead supports carried by the shell, d) said supports having head supporting annular edges, located at different radial distances from an axis defined by the shell, e) said supports having flanks that taper toward said edges, the flanks furthest from said axis extending at different angles relative to said axis, f) whereby when either of said drum heads is struck by a beater, the audible resonation of the drum exceeds resonation that occurs when both heads are of the same supported diameter.

* * * * *